US007946031B2

(12) United States Patent
Caveney

(10) Patent No.: US 7,946,031 B2
(45) Date of Patent: May 24, 2011

(54) METHOD FOR FORMING AN ENHANCED COMMUNICATION CABLE

(75) Inventor: Jack E. Caveney, Hinsdale, IL (US)

(73) Assignee: Panduit Corp., Tinley Park, IL (US)

( * ) Notice: Subject to any disclaimer, the term of this patent is extended or adjusted under 35 U.S.C. 154(b) by 976 days.

(21) Appl. No.: 11/735,132

(22) Filed: Apr. 13, 2007

(65) Prior Publication Data

US 2007/0181335 A1 Aug. 9, 2007

Related U.S. Application Data

(63) Continuation of application No. 11/353,885, filed on Feb. 14, 2006, now Pat. No. 7,205,479.

(60) Provisional application No. 60/653,286, filed on Feb. 14, 2005.

(51) Int. Cl.
*H01R 43/00* (2006.01)

(52) U.S. Cl. ..... 29/828; 29/33 F; 174/27; 174/113 AS; 264/508

(58) Field of Classification Search ..... 174/27–29, 174/110 R, 112, 113 AS, 113 C, 113 R; 264/508, 264/514; 29/33 F, 33 T, 825, 828
See application file for complete search history.

(56) References Cited

U.S. PATENT DOCUMENTS

| | | | |
|---|---|---|---|
| 476,484 | A | 6/1892 | Patterson |
| 527,414 | A | 10/1894 | Dewees |
| 630,697 | A | 8/1899 | Highfield et al. |
| 1,993,526 | A | 3/1935 | Rihl |
| 2,048,811 | A | 7/1936 | Peirce |
| 2,956,311 | A | 10/1960 | Raydt et al. |
| 3,086,557 | A | 4/1963 | Peterson |
| 3,349,156 | A | 10/1967 | Zieg |
| 3,435,105 | A | 3/1969 | Ferrari |
| 3,538,209 | A | 11/1970 | Hegler |
| 3,650,862 | A | 3/1972 | Burr |

(Continued)

FOREIGN PATENT DOCUMENTS

DE 1704718 A 7/1971

(Continued)

OTHER PUBLICATIONS

Krone, "Krone airES Technology", brochure, 2003, 6 pages, Centennial, Colorado.

*Primary Examiner* — Donghai D. Nguyen
(74) *Attorney, Agent, or Firm* — Robert A. McCann; Zachary J. Smolinski; Christopher K. Marlow

(57) ABSTRACT

A cable and method of forming the cable are presented. The cable contains twisted wire pairs disposed in a cavity defined by a jacket. Each wire has a conductor and an insulator surrounding the conductor. The cable may also contain a spline that separates the twisted wire pairs. At least one of the insulators or the jacket is helically corrugated such that ridges extend radially inward or outward. The ridges of the insulators may be the same or different. The cable is extruded from an extruder. The jacket may contain corrugations after being extruded by the extruder. The cable may be passed through dies to form a helically corrugated jacket. The jacket heated by a heater prior to being passed through the dies, or may pass through the dies while still hot from the extruder.

7 Claims, 7 Drawing Sheets

U.S. PATENT DOCUMENTS 3,692,889 A 9/1972 Hetrich
3,705,779 A 12/1972 Zon
3,776,679 A 12/1973 Hegler
3,959,427 A 5/1976 Van Zon
3,996,323 A 12/1976 Hegler et al.
4,317,955 A 3/1982 Choi
4,394,705 A 7/1983 Blachman
4,555,230 A 11/1985 Lupke
4,731,138 A 3/1988 Lupke
4,853,516 A 8/1989 Julien et al.
4,866,212 A * 9/1989 Ingram ..... 174/28
4,953,946 A 9/1990 Huybrechts
5,077,449 A * 12/1991 Cornibert et al. ..... 264/514
5,286,923 A 2/1994 Prudhon et al.
5,330,600 A 7/1994 Lupke
5,383,998 A 1/1995 Lupke
5,442,131 A 8/1995 Borgwarth
5,544,270 A 8/1996 Clark et al.
5,606,151 A 2/1997 Siekierka et al.
5,696,352 A 12/1997 Kourimsky
5,777,260 A 7/1998 Klumps et al.
5,827,468 A 10/1998 Jenewein
5,922,155 A 7/1999 Clouet et al.
5,985,448 A 11/1999 Koenig
5,990,419 A 11/1999 Bogese, II
6,074,503 A 6/2000 Clark et al.
6,452,105 B2 9/2002 Badii et al.
6,465,737 B1 10/2002 Bonato et al.
6,476,326 B1 11/2002 Fuzier et al.
6,541,708 B2 4/2003 Suehiro
6,570,095 B2 5/2003 Clark et al.
6,573,456 B2 6/2003 Spruell et al.
6,596,944 B1 7/2003 Clark et al.
6,639,152 B2 10/2003 Glew et al.
6,686,537 B1 2/2004 Gareis et al.
6,743,983 B2 6/2004 Wiekhorst et al.
6,787,694 B1 9/2004 Vexler et al.
6,787,697 B2 9/2004 Stipes et al.
6,812,408 B2 11/2004 Clark et al.
6,815,611 B1 11/2004 Gareis
6,825,418 B1 * 11/2004 Dollins et al. ..... 174/112
6,855,889 B2 2/2005 Gareis
2002/0079126 A1 6/2002 Valenzuela
2003/0205402 A1 11/2003 Koyasu et al.
2004/0055779 A1 3/2004 Wiekhorst et al.
2004/0055781 A1 3/2004 Cornibert et al.
2004/0062496 A1 4/2004 Shuman et al.
2004/0149484 A1 8/2004 Clark
2004/0216914 A1 11/2004 Vexler et al.
2004/0256139 A1 12/2004 Clark
2005/0006132 A1 1/2005 Clark
2005/0056454 A1 3/2005 Clark
2005/0189135 A1 9/2005 Clark

FOREIGN PATENT DOCUMENTS

GB 804560 A 11/1958
WO 9320564 A1 10/1993

* cited by examiner

METHOD FOR FORMING AN ENHANCED COMMUNICATION CABLE

CROSS-REFERENCE TO RELATED APPLICATIONS

This application claims priority to U.S. application Ser. No. 11/353,885, filed on Feb. 14, 2006, now U.S. Pat. No. 7,205,479, which claims the benefit of priority to U.S. Provisional Application No. 60/653,286, filed Feb. 14, 2005. The above applications are hereby incorporated by reference in their entireties.

FIELD OF THE INVENTION

The present invention relates generally to communications cables and more specifically relates to apparatus and methods for reducing alien crosstalk between communications cables.

BACKGROUND OF THE INVENTION

Suppression of alien crosstalk in communication systems is an increasingly important practice for improving systems' reliability and the quality of communication. As the bandwidth of a communication systems increases, so does the importance of reducing or eliminating alien crosstalk.

In wired communication systems, crosstalk is caused by electromagnetic interference within a communication cable or between cables. Crosstalk resulting from interaction between cables is known as alien crosstalk. Alien near-end crosstalk (alien NEXT) occurs when signals transmitted on one cable disturb signals in another cable. Alien NEXT travels in the disturbed cable in the direction opposite the direction of signal travel in the disturbing cable. As communications signal frequencies and data transmission rates increase, alien NEXT becomes problematic and is a barrier to increased signal frequencies and data transmission rates. Alien crosstalk degrades or destroys performance, for example, in 10 Gbps Ethernet communications over installed cable such as Cat 5e, Cat 6, or Cat 6e cable.

The magnitude of alien crosstalk increases with increased capacitance between nearby cables. Thus, alien crosstalk can be decreased by decreasing this capacitance. Capacitance, in turn, may be decreased in two ways: by increasing the distance between cables, and by decreasing the effective dielectric constant of the material between the two cables. Because there are physical barriers to increasing the distance between two cables—including cable size considerations—it is desirable to space cables (or conductors within a cable) at an acceptable distance from each other while minimizing the effective dielectric constant of the material between cables.

Air is the most effective low-dielectric-constant material, but other materials must be placed between cables to provide insulation and physical separation. The present invention is directed to structures and methods that decrease the effective dielectric constant between cables while maintaining a desirable physical separation between the cables. Structures and methods according to some embodiments of the present invention may be applied to previously installed cabling.

SUMMARY OF THE INVENTION

According to one embodiment of the present invention, insulation is provided along cables to decrease alien crosstalk between cables.

According to some embodiments of the present invention, a communication cable jacket is provided to increase the physical separation between adjacent cables while maintaining low capacitance between the cables.

According to some embodiments of the present invention, a cable jacket is helically corrugated to provide air space and physical separation between adjacent cables.

Cables may be newly manufactured with jacket structures according to the present invention.

DETAILED DESCRIPTION OF THE ILLUSTRATED EMBODIMENTS

Figure 1:
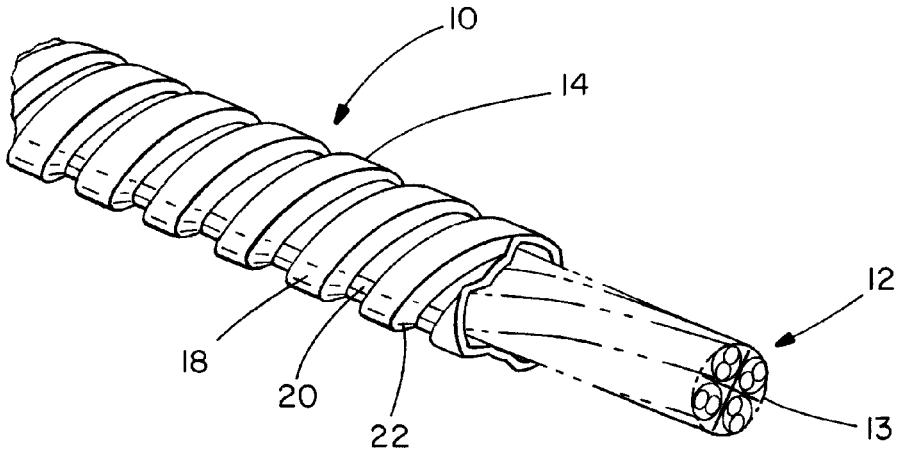
FIG. 1 is a perspective view of a helically corrugated data cable jacket.

Turning now to FIG. 1, a data cable 10 is shown. The data cable 10 comprises twisted wire pairs 12 with a helically corrugated tube 14 overlaid around the twisted wire pairs 12.

In one embodiment of the present invention, a data cable is manufactured with the helically corrugated tube 14 surrounding the twisted wire pairs 12. In this case, the helically corrugated tube 14 is the jacket of the data cable 10. The twisted wire pairs 12 are separated by a spline 13.

The helically corrugated jacket 14 is provided with ridges 18 and depressions 20. Side walls 22 join the ridges 18 to the depressions 20 and may be provided at an angle, as more clearly shown in FIG. 3. The use of angled side walls 22 allows for easier removal of the helically corrugated jacket 14 from mold blocks in some methods of manufacture of the jacket. One method for manufacturing jackets according to the present invention is the vacuum molding of a jacket using a continuous vacuum molding and corrugating machine.

Figure 2:
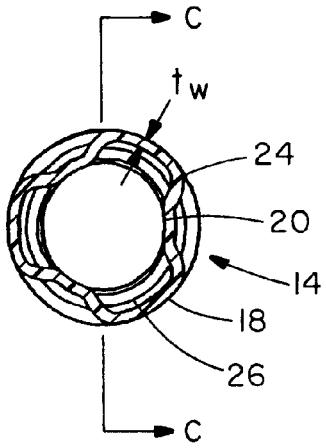
FIG. 2 is an end view of a helically corrugated jacket according to one embodiment of the present invention.

As more clearly seen in the end view shown in FIG. 2, according to one embodiment of the present invention, the helically corrugated jacket 14 comprises a corrugated wall 24 having a substantially uniform thickness, $t_w$. The alternating ridges 18 and depressions 20 form gaps 26 between the helically corrugated jacket 14 and the twisted wire pairs 12.

According to one embodiment of the present invention, the gaps 26 remain filled with air, so that the use of the helically corrugated jacket 14 increases the minimum physical separation between adjacent cables along the cable path. This embodiment also maintains a low effective dielectric constant for the material between adjacent cables by increasing the effective air space between adjacent cables. In the embodiment shown in FIGS. 1-3, three helices are provided along the helically corrugated jacket 14, but more or fewer helices may be provided in alternative embodiments.

Figure 3:
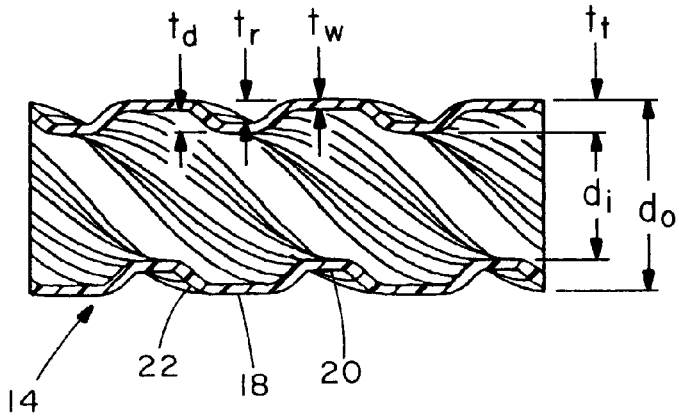
FIG. 3 is a side cross-sectional view of the helically corrugated jacket of FIG. 2 along the line C-C of FIG. 2.

Turning to FIG. 3, a cross-sectional view of the helically corrugated jacket 14 taken along the line C-C of FIG. 2 is shown. The helically corrugated jacket 14 has an outer diameter, $d_o$, formed by the outer edges of the ridges 18 and an inner diameter, $d_i$, formed by the inner edges of the depressions 20. The thickness $t_w$ of the corrugated wall 24 can also be seen in FIG. 3.

Helically corrugated jackets according to the present invention may be manufactured of a variety of materials and with a variety of dimensions. For example, for use in standard (non-plenum) deployments, jackets may be manufactured of flame retardant polyethylene. For deployments in air ducts, jackets may be manufactured of plenum-grade PVC.

The dimensions of helically corrugated jackets according to the present invention are preferably selected to increase air space between adjacent cables, decrease the amount of material used in the construction of the helically corrugated jackets, and still maintain acceptable inner and outer diameters ($d_i$ and $d_o$) for the helically corrugated jacket 14.

Referring again to FIG. 3, a number of dimensions of the helically corrugated jacket 14 can be selected to result in desired tube size and net dielectric characteristics. The shown dimensions are as follows:

$t_w$=Thickness of the corrugated wall 24

$t_t$=Thickness of the helically corrugated jacket 14 from the inner surface of the depressions 20 to the outer surface of the ridges 18

$t_r$=Thickness from the outer surface of a depression 20 to the outer surface of a ridge 18

$t_d$=Thickness from the inner surface of a depression 20 to the inner surface of a ridge 18

$d_o$=Outside diameter of the helically corrugated jacket 14

$d_i$=Inside diameter of the helically corrugated jacket 14

Figure 4:
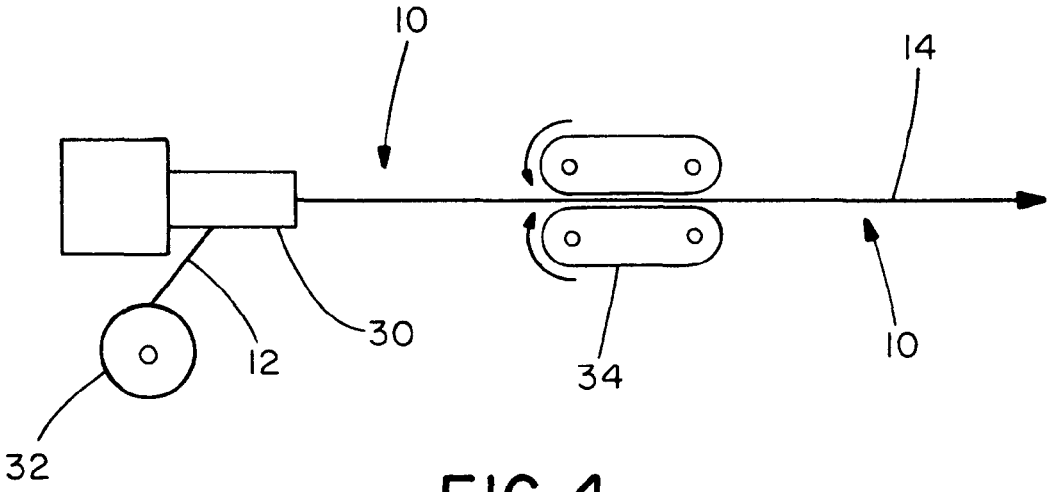
FIG. 4 is a schematic of the manufacture of a cable according to one embodiment of the present invention.

Turning now to FIG. 4, one method of manufacturing the helically corrugated jacket 14 over the twisted wire pairs 12 will be described. In this embodiment, an extruder 30 is provided. The twisted wire pairs 12 are stored on a spool 32 and fed into the extruder 30, and the jacket is over-extruded. The still-hot jacketed cable 10 passes through a set of matched tractor drive vacuum-forming dies 34. The dies 34 vacuum-form the helically corrugated jacket 14 into the desired spiral-convoluted shape.

The finished jacket 14 is, geometrically, partially air and has a reduced volume of jacket material, which reduces the effective dielectric. This also spaces adjacent cables further from each other, reducing alien cross-talk.

Figure 5:
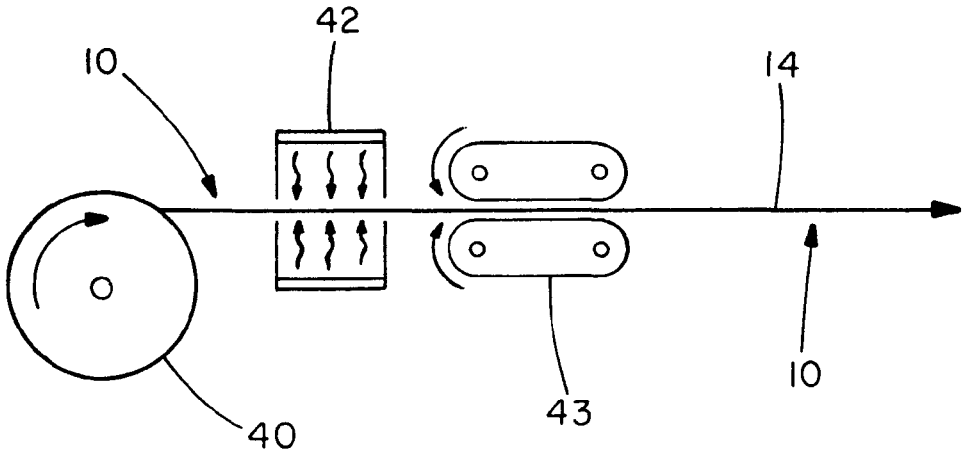
FIG. 5 is a schematic of the manufacture of a cable according to another embodiment of the present invention.

FIG. 5 illustrates another method of manufacturing the helically corrugated jacket 14 over the twisted wire pairs 12. In this embodiment, the completed cable 10, including the jacket (non-corrugated) and the twisted wire pairs 12, are stored on a spool 40. The cold cable is heated by heaters 42 and then passed through vacuum-forming dies 43. As in the embodiment described above, the vacuum-forming dies 43 vacuum-form the jacket 14 into the desired spiral-convoluted shape. The spiral-convoluted jacket 14 improves the overall cable performance as described above.

Figure 6:
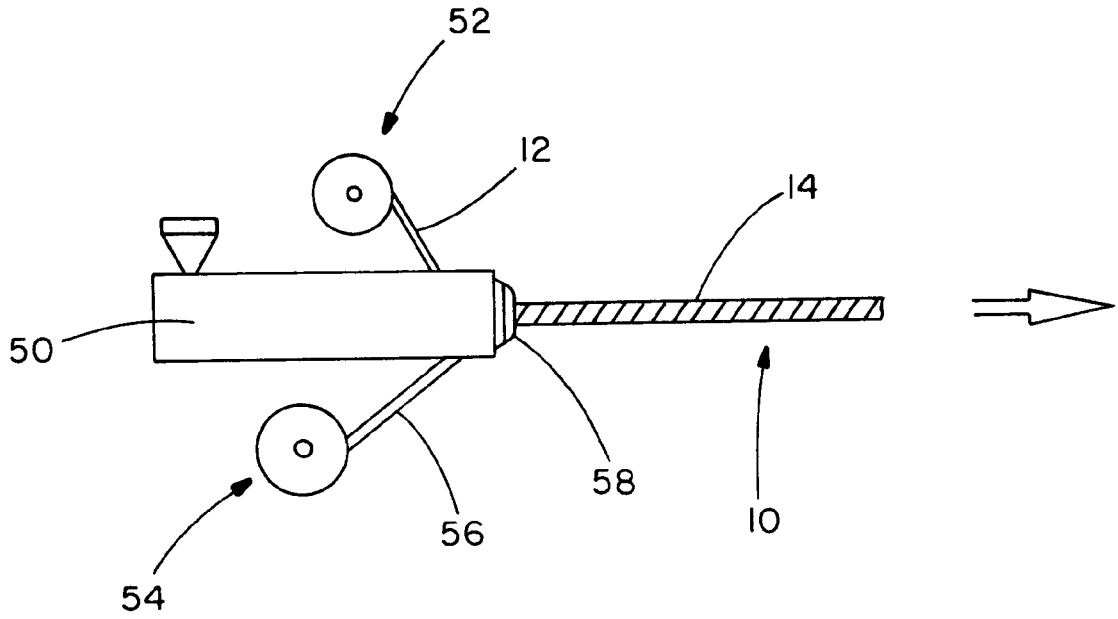
FIG. 6 is a schematic of the manufacture of a cable according to another embodiment of the present invention.
Figure 7A:
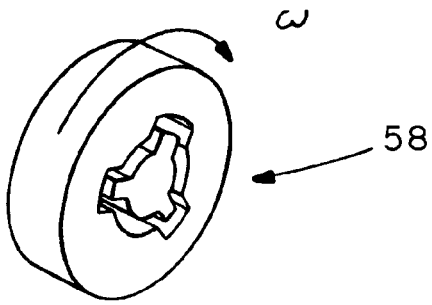
FIG. 7*a* is a perspective view of a rotating die of FIG. 6 for the corrugated cable jacket of FIG. 1.
Figure 7B:
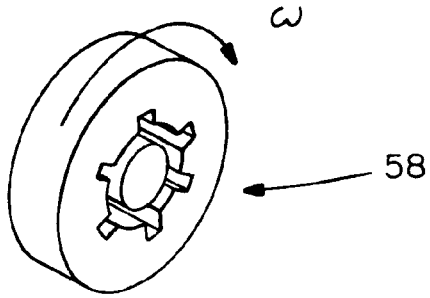
FIG. 7*b* is a perspective view of a rotating die of FIG. 6 for the corrugated cable jacket of FIG. 8*a;*
Figure 7C:
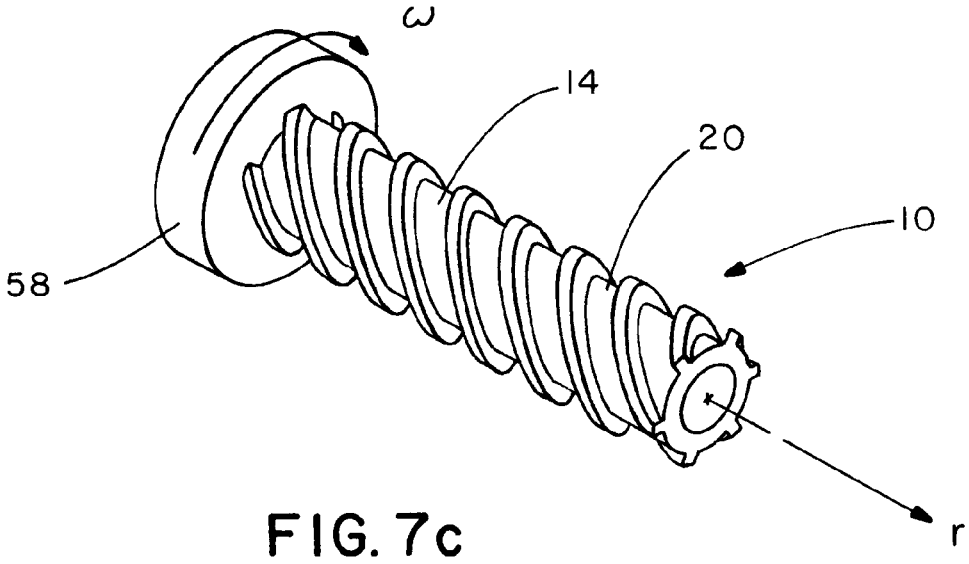
FIG. 7*c* is a perspective view of a rotating die of FIG. 6 and the corrugated cable jacket of FIG. 8*a* as the jacket is extruded.

Turning now to FIG. 6, an additional method of manufacturing the cable 10 will be described. In this embodiment, an extruder 50 is provided. The twisted wire pairs 12 are stored on a spool 52 and fed into the extruder 50. Stored on a second spool 54 is a spline 56 (shown in more detail in FIGS. 8*a* and 8*b*) that is also fed into the extruder 50. As shown in FIGS. 7*a*, 7*b*, and 7*c*, a rotating die 58 is located at the end of the extruder 50. The die is rotated at an angular velocity $\omega$ and the cable 10 is extruded at a linear velocity $\upsilon$ in the direction indicated. The rotation of the die 58 during the extrusion process yields a spiral jacket 14 for the cable 10. By varying the angular velocity $\omega$ and the extrusion velocity $\upsilon$, the pitch of the depressions 20 can be varied.

Figure 8A:
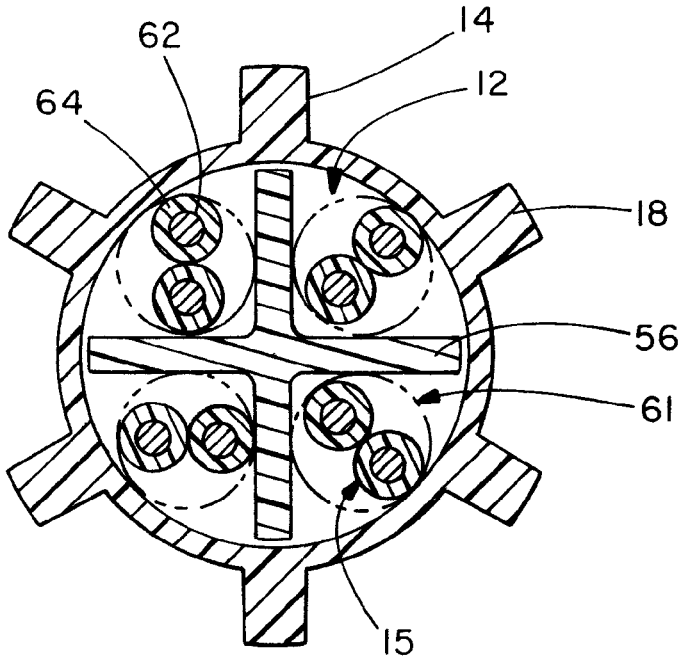
FIG. 8*a* is a cross-sectional end view of a cable according to one embodiment of the present invention.

A cross-section of one embodiment of a data cable is illustrated in FIG. 8*a*. The data cable includes four twisted wire pairs 12. Each twisted wire pair 12 has an outer diameter indicated at 61. Each of the wires 15 includes an inner conductor 62 and an insulation 64. The four twisted wire pairs 12 are separated by the spline 56. As shown in this embodiment, the spiral ridges 18 are on the outside of the jacket 14.

Figure 8B:
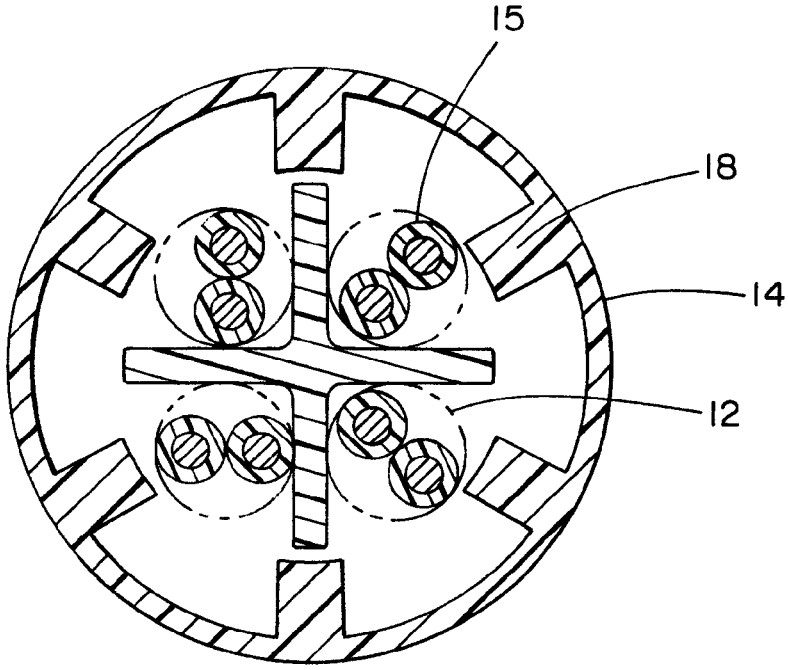
FIG. 8*b* is a cross-sectional end view of a cable according to another embodiment of the present invention.
Figure 8C:
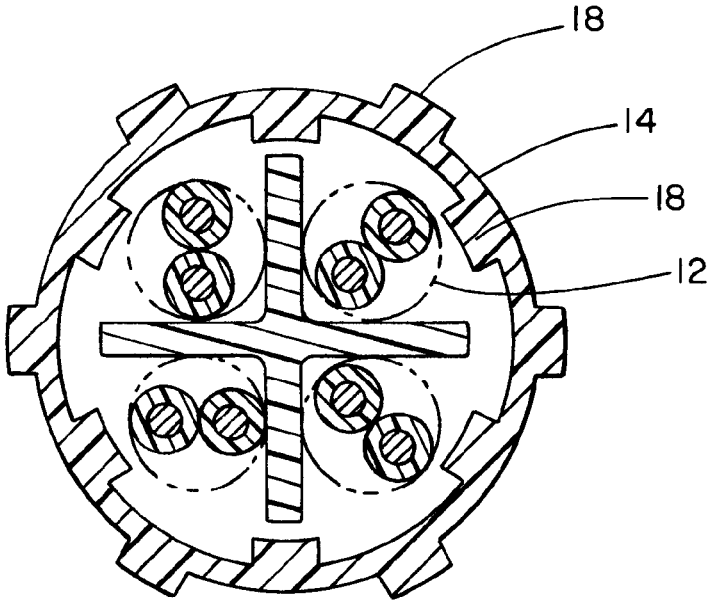
FIG. 8*c* is a cross-sectional end view of a cable according to another embodiment of the present invention.
Figure 8D:
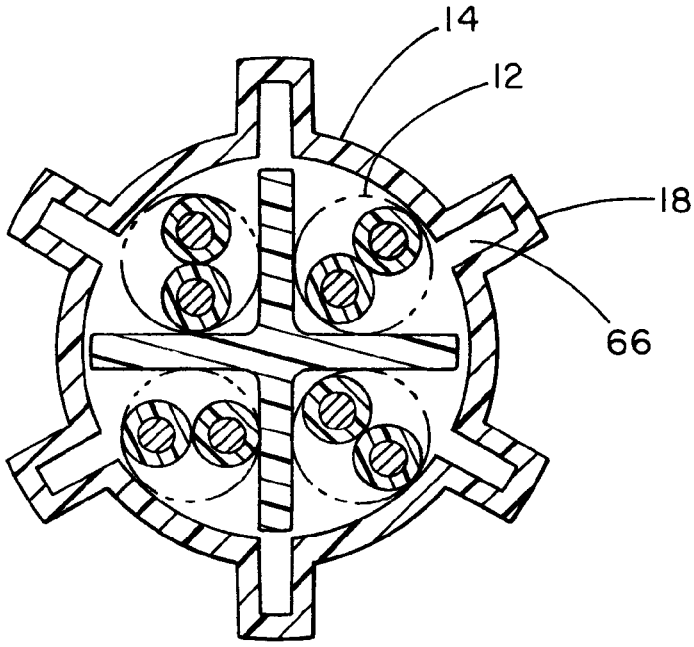
FIG. 8*d* is a cross-sectional end view of a cable according to yet another embodiment of the present invention.

In the embodiment shown in FIG. 8*b*, the spiral ridges 18 are on the inside of the jacket 14. The spiral ridges 18 are on both the inside and the outside of the jacket 14 in the data cable shown in FIG. 8*c*. FIG. 8*d* illustrates a cored or thin-walled spiral jacket 14. In this embodiment, the ridges 18 include gaps 66.

Figure 9:
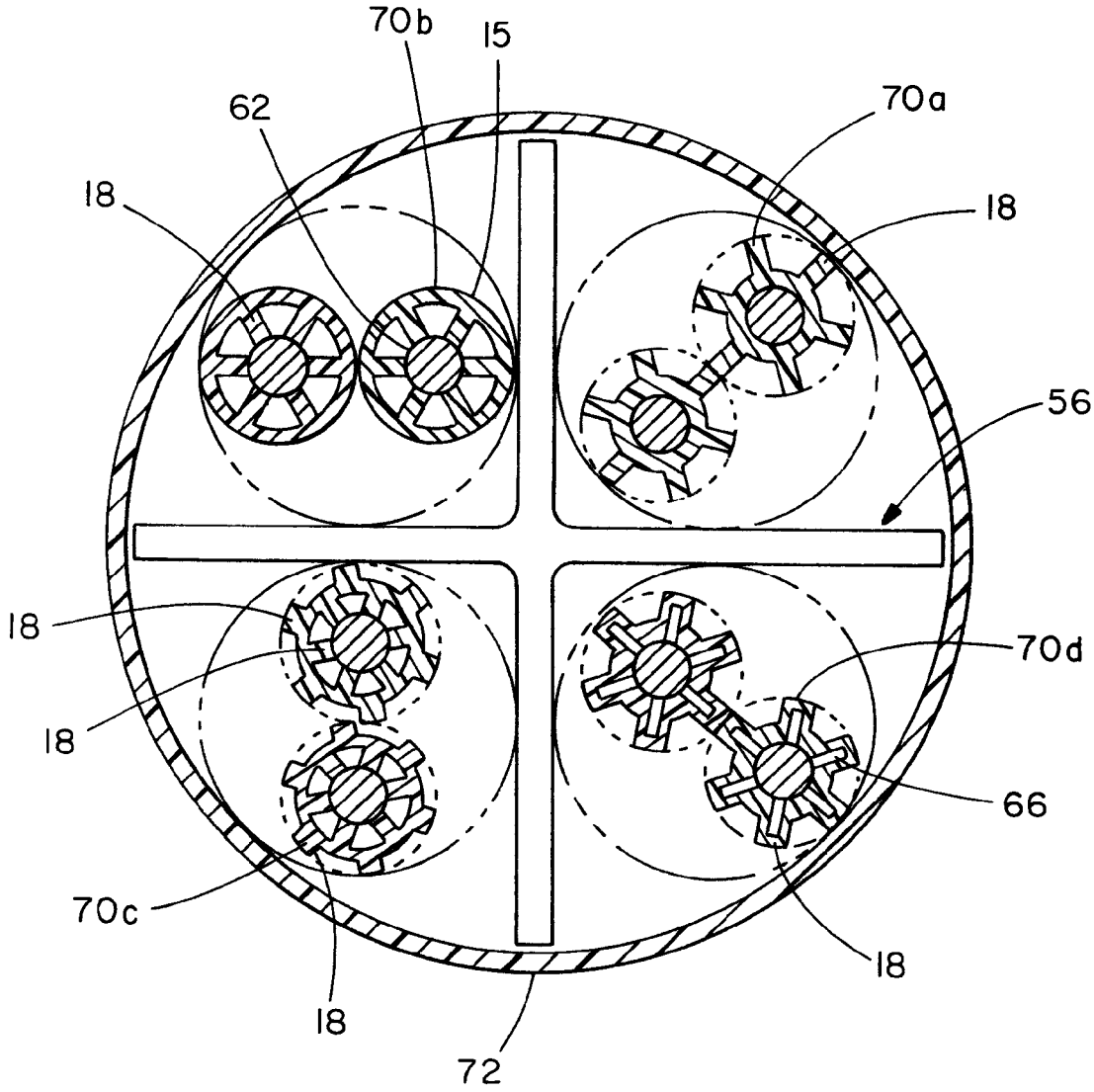
FIG. 9 is a cross-sectional end view of a cable illustrating various insulation cross-sections for twisted pairs within a cable.

Turning now to FIG. 9, another embodiment of the present invention will be described. Each of the wires 15 includes a spiraled outer covering 70*a-d*. The wires 15 each include the inner conductor 62. The spiral outer coverings 70*a-d* can be manufactured using methods similar to those described above in conjunction with FIGS. 4-7. As shown in FIG. 9, each of the wires of the twisted pairs 12 has a different pattern of ridges 18. However, in use, all wires may include the same pattern of ridges 18. In other embodiments having spiraled coverings over the wires, the outer jacket 72 may also be corrugated.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention.

The invention claimed is:

1. A method of forming a cable, the method comprising:

feeding twisted wire pairs into an extruder, each wire of the twisted wire pairs including a conductor and an insulator surrounding the conductor;

extruding a jacket over the twisted wire pairs to form a jacketed cable from the extruder, the jacketed cable containing the twisted wire pairs disposed in a cavity defined by the jacket;

storing the jacketed cable on a spool before passing the jacketed cable through dies;

unspooling the jacketed cable;

heating the jacketed cable after unspooling the jacketed cable; and passing the jacketed cable through the dies while the jacketed cable is still hot from the heating to form a helically corrugated jacket, wherein at least one of:

the helically corrugated jacket is corrugated such that cored ridges extend outwardly from the axial center of the cable to form an air gap that extends from the cavity, or at least one of the insulators is corrugated such that cored ridges extend outwardly from the conductor to form an air gap that extends from the conductor associated with the insulator.

2. The method of claim 1 wherein the at least one of the insulators is corrugated such that the cored ridges extend outwardly from the conductor to form the air gap that extends from the conductor.

3. The method of claim 1 wherein the helically corrugated jacket is corrugated such that the cored ridges extend outwardly from the axial center of the cable to form the air gap that extends from the cavity.

4. The method of claim 1 wherein a spline is surrounded by the helically corrugated jacket and separates the twisted wire pairs.

5. The method of claim 1 wherein the helically corrugated jacket and the at least one of the insulators have different types of corrugations when the at least one of the insulators contains corrugations.

6. The method of claim 1 wherein the insulators do not contain corrugations.

7. The method of claim 1 wherein at least some of the insulators have different types of corrugations.

* * * * *